US007084338B2

(12) United States Patent
Hagiwara

(10) Patent No.: US 7,084,338 B2
(45) Date of Patent: Aug. 1, 2006

(54) LUG FIXING STRUCTURE FOR DRUM

(75) Inventor: Takashi Hagiwara, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 20 days.

(21) Appl. No.: 10/426,793

(22) Filed: May 1, 2003

(65) Prior Publication Data

US 2004/0065185 A1 Apr. 8, 2004

(30) Foreign Application Priority Data

Oct. 7, 2002 (JP) ..... 2002-293364

(51) Int. Cl.
*G10D 13/02* (2006.01)

(52) U.S. Cl. ..... 84/413; 84/411 R; 84/411 A

(58) Field of Classification Search ..... 84/413, 84/411 R, 411 A
See application file for complete search history.

(56) References Cited

U.S. PATENT DOCUMENTS

| | | | | |
|---|---|---|---|---|
| 3,533,324 | A | 10/1970 | Price | |
| 4,144,794 | A | 3/1979 | Silverman | |
| 4,475,434 | A * | 10/1984 | Willis | 84/411 R |
| 4,506,586 | A | 3/1985 | Brewer | |
| D279,103 | S | 6/1985 | Ayotte | |
| 4,583,442 | A | 4/1986 | Minor | |
| 4,693,163 | A | 9/1987 | Hsieh | |
| 4,694,726 | A | 9/1987 | Silvestri | |
| 4,903,569 | A * | 2/1990 | Kurosaki | 84/413 |
| 4,928,566 | A | 5/1990 | Yanagisawa | |
| 6,365,811 | B1 | 4/2002 | Conta | |

FOREIGN PATENT DOCUMENTS

| | | |
|---|---|---|
| GB | 1214100 | 12/1970 |
| JP | 55-566 | 1/1980 |
| JP | 60-176491 | 11/1985 |
| JP | 63-128595 | 6/1988 |
| JP | 2-58269 | 2/1990 |
| JP | 4-93887 | 3/1992 |
| JP | 2002-366140 | 12/2002 |

OTHER PUBLICATIONS

Ayotte Drums, Canada: Tunelock Tension System, Rack and Pinion Snare Release.
Copy of Japanese Office Action dated Apr. 26, 2005 (and English translation of relevant portion).

* cited by examiner

*Primary Examiner*—Shih-Yung Hsieh
(74) *Attorney, Agent, or Firm*—Dickstein, Shapiro, Morin & Oshinsky, LLP.

(57) ABSTRACT

A hollow cylinder of a drum is equipped with a lug fixing structure for detachably attaching a lug thereto by using a lug fixing member, which projects externally from the hollow cylinder and engages with an engagement hole of the lug. Herein, the lug fixing member has a spacer by which the lug is spaced apart from the exterior circumferential surface of the hollow cylinder and would not come in direct contact with the hollow cylinder. Thus, it is possible not to prevent the hollow cylinder from vibrating during playing of a drum. In addition, the lug is turned over after released from the lug fixing member, which is thus prevented from being engaged with the engagement hole of the lug again. This guarantees rapid replacement of a drumhead because a human operator can easily release engagement between the lug and lug fixing member without performing troublesome operation.

8 Claims, 11 Drawing Sheets

LUG FIXING STRUCTURE FOR DRUM

BACKGROUND OF THE INVENTION

1. Field of the Invention

This invention relates to structures for fixing lugs to drums such as bass drums, snare drums, and marching drums, for example.

2. Description of the Related Art

In general, drums such as bass drums, snare drums, and marching drums are equipped with drumhead stretching mechanisms for supporting and stretching drumheads, to which prescribed tensions are applied. An example of a drumhead stretching mechanism (or a clamping mechanism) is disclosed in Japanese Unexamined Patent Publication No. 2002-366140.

A conventional example of a snare drum equipped with a drumhead stretching mechanism will be described with reference to FIGS. 9 and 10, wherein FIG. 9 is a perspective view showing an exterior appearance of a snare drum 16, which is vertically reversed upside down, and FIG. 10 is a cross sectional view showing a lug fixing structure for use in the snare drum 16 of FIG. 9. Specifically, reference numeral 1 designates a hollow cylinder (corresponding to a body of a snare drum) whose both ends are open, 2 designates a drumhead, 2*a* designates a front-side drumhead, 2*b* designates a backside drumhead (or a snare head), and 3 designates a drumhead stretching mechanism for supporting and stretching the drumhead 2 under tension.

The drumhead stretching mechanism 3 is constituted by a ring head frame 5 that is equipped with the outer circumference of the opening of the hollow cylinder 1 to hold outer circumferential ends of the drumhead 2, a ring clamp frame (or rim) 6 that is equipped with the outer circumference of the opening of the hollow cylinder 1, a plurality of lugs 8 that are arranged with prescribed distances therebetween and are fixed to the outer circumference of the hollow cylinder 1 by bolts 7 and nuts, and a plurality of bolts 9 that are arranged with prescribed distances therebetween and are attached to the clamp frame 6. Each of the bolts 9 is inserted through a bolt fixing hole 11 of the clamp frame 6 via a washer 12 and is engaged with a lug nut 13 of the. lug 8, so that the clamp frame 6 and the lugs 8 are interconnected together. The lug nut 13 is normally pressed towards the bolt 9 by a compression coil spring 14, so that it is pressed to the interior wall of the lug 8. In the aforementioned structure, when the bolt 9 is clamped using a tuning key (not shown) so that the clamp frame 6 is pressed to the head frame 5, the head frame 5 is moved to the lugs 8 so that the drumhead 2 is automatically expanded in a diameter direction thereof, wherein a tension applied to the drumhead 2 is increased, thus adjusting the snare drum in tone color and tone pitch. Incidentally, reference numeral 15 designates a snappy (or a snare) arranged for the backside drumhead 2*b*.

In the snare drum 16 described above, the lugs 8 are fixed to the outer circumference of the hollow cylinder 1 by bolts 7, and the lug nuts 13 are firmly installed in the lugs 8 in such a way that the lug nuts 13 will not easily fall off from the lugs 8. For this reason, in order to replace the drumhead 2 with a new one, a human operator (e.g., a player or a user) should first loosen the bolts 9 to be extracted from the lug nuts 13, and then, the human operator removes the clamp frame 6 and the head frame 5 from the hollow cylinder 1. Therefore, it is very troublesome for the human operator to extract the bolts 9 from the lug nuts 13, which takes a relatively long time.

When installing a new drumhead in the hollow cylinder 1, the human operator should first attach the head frame 5 and the clamp frame 6 to the hollow cylinder 1, and then, the human operator puts the bolts 9 into the lug nuts 13 so as to operate the clamp frame 6 clamping the head frame 5. Herein, it is very troublesome for the human operator to screw the bolts 9 into the lug nuts 13.

To overcome the aforementioned drawbacks, it is possible to provide a lug nut fixing structure shown in FIG. 11, wherein a specially designed clamp member 21 constituted by a main portion 21A, hooks 21B, and a slot 21C is substituted for the aforementioned lug 8. The clamp member 21 is fixed to the outer circumference of the hollow cylinder 1 by a screw. In addition, a tapped hole 22 is formed at approximately the center of the lug nut 13 having a rod-like shape in a longitudinal direction, and it penetrates through the lug nut 13 in a diameter direction. Furthermore, the bolt 9 is put into and engaged with the tapped hole 22 of the lug nut 13, which is then engaged with the hooks 21B of the clamp member 21, so that the bolt 9 is inserted into the slot 21 C of the clamp member 21.

In the above, when the bolt 9 is rotated to be loosened so that the lug nut 13 is moved towards the tip end of the bolt 9 but does not fall off from the bolt 9, it is possible to easily take off the lug nut 13 from the hooks 21B of the clamp member 21. That is, it is possible to easily replace a drumhead with a new one without extracting the bolt 9 from the lug nut 13.

However, the aforementioned lug nut fixing structure shown in FIG. 11 suffers from a problem in that, similarly to the aforementioned lug 8 shown in FIGS. 9 and 10, a relatively large contact area is required for the clamp member 21 to be brought into contact with the outer circumference of the hollow cylinder 1 in order not to prevent the hollow cylinder 1 from vibrating during playing of a drum.

In addition, after the bolt 9 is loosened, the bolt 9 is rotatably moved in a direction A about a point at which the bolt 9 is interconnected with the clamp frame 6, so that the lug nut 13 is taken off from the hooks 21B of the clamp member 21. Thereafter, when the bolt 9 is rotatably moved backwards, the lug nut 13 is moved under the hooks 21B and thus unexpectedly hooked on the clamp member 21 again. For this reason, when the drumhead 2 is replaced with a new one, the human operator should temporarily hold the bolt 9, which is loosened and is taken off from the clamp member 21, by hand so as not to move backwards under the hooks 21B, and then, the human operator should remove the clamp frame 6 from the hollow cylinder 1. However, it is very difficult for the human operator to temporarily hold all the bolts 9, which are arranged with equal distances therebetween on the outer circumference of the hollow cylinder 1. This still indicates that there is a room for further improvement in the lug nut fixing structure of FIG. 11 similarly to the foregoing lug fixing structure shown in FIGS. 9 and 10 because it is still a nuisance to replace the drumhead 2 with a new one.

SUMMARY OF THE INVENTION

It is an object of the invention to provide a lug fixing structure that allows rapid replacement of a drumhead with ease, wherein lugs are arranged so as not to prevent a hollow cylinder from vibrating during playing of a drum.

A lug fixing structure of this invention is designed such that a lug is fixed in position to the exterior circumferential surface of a hollow cylinder of a drum by using a lug fixing member. Specifically, the lug has an engagement hole that is engaged with the lug fixing member projected externally from the exterior circumferential surface of the hollow cylinder, whereby the lug is detachably attached to the hollow cylinder. Herein, the lug fixing member has a spacer by which the lug is spaced apart from the exterior circumferential surface of the hollow cylinder and would not come in direct contact with the hollow cylinder; thus, it is possible not to prevent the hollow cylinder from vibrating during playing of a drum. In addition, the engagement hole of the lug is formed in a keyhole shape constituted by a large-diameter hole portion and an elongated hole portion, by which the lug fixing member can be easily engaged with the engagement hole and reliably prevented from being unexpectedly extracted from the engagement hole of the lug.

In the above, when the lug fixing member is taken off from the engagement hole of the lug, the lug is turned over to prevent the lug fixing member from being engaged with the engagement hole of the lug again.

Thus, a human operator (e.g., a player or a user) can rapidly replace a drumhead with a new one because this invention allows the human operator to easily release engagement between the lug and lug fixing member.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENTS

This invention will be described in further detail by way of examples with reference to the accompanying drawings.

Figure 1:
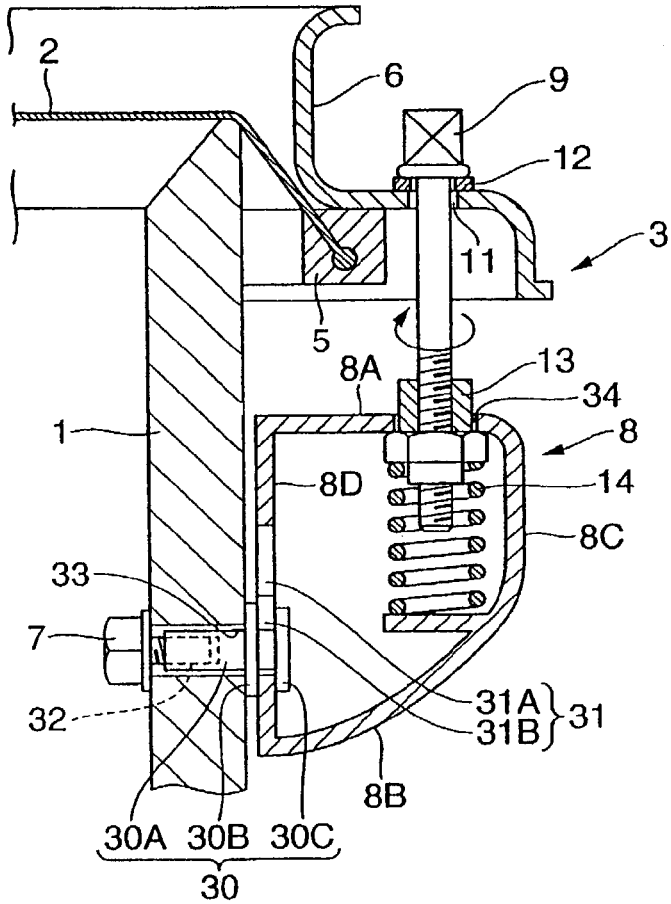
FIG. 1 is a cross sectional view showing a lug fixing structure for a drum in accordance with a first embodiment of the invention.
Figure 2:
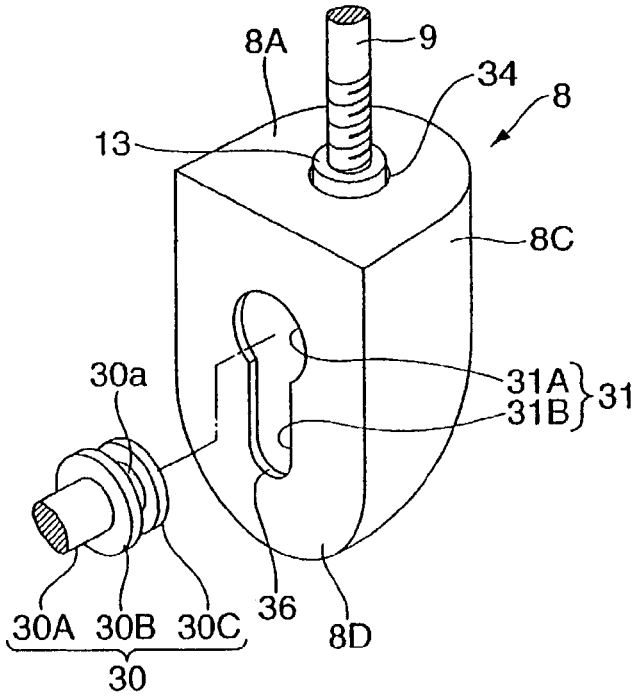
FIG. 2 is a perspective view showing essential parts of the lug fixing structure shown in FIG. 1.
Figure 3:
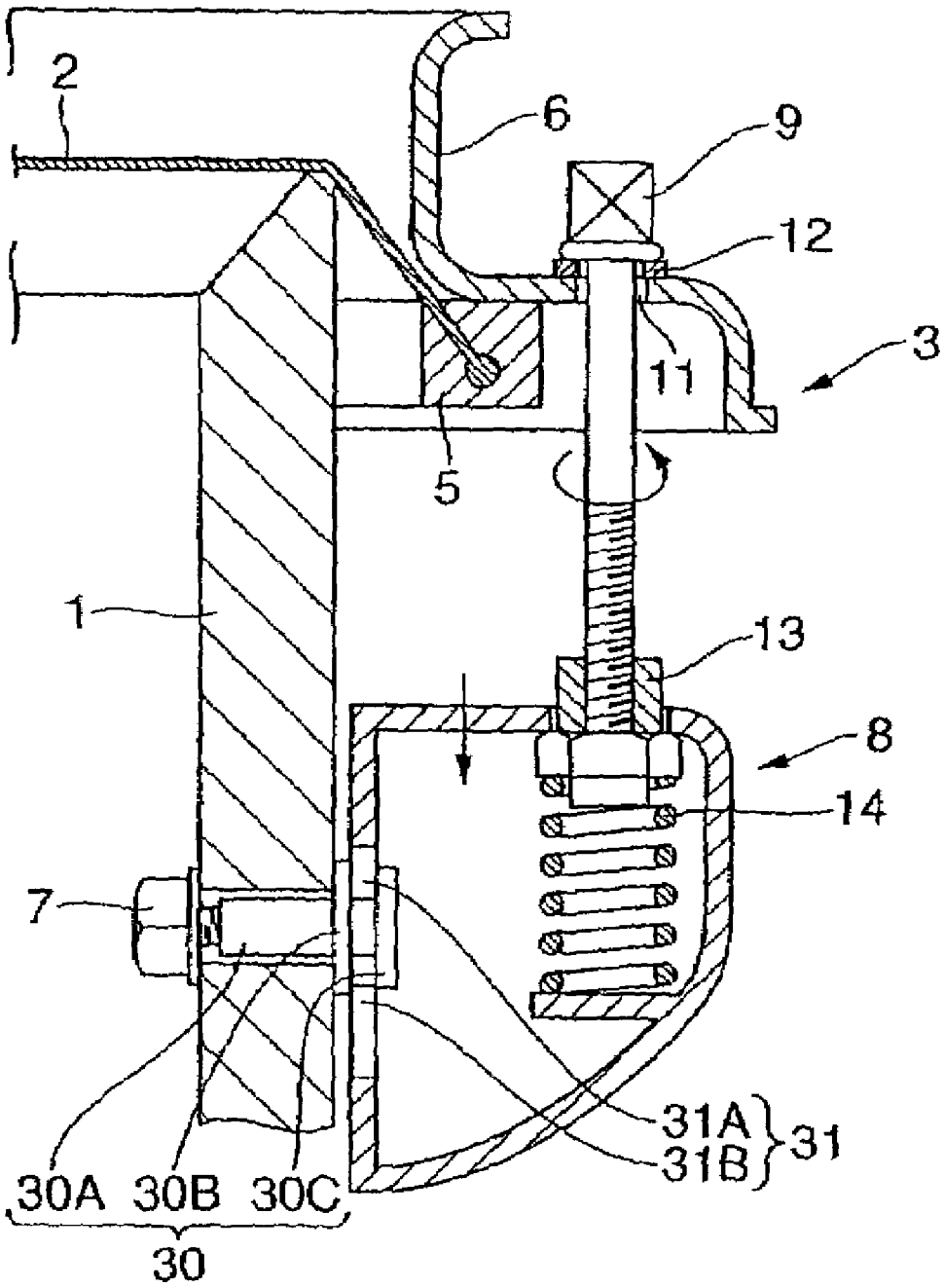
FIG. 3 is a cross sectional view of the lug fixing structure in which a bolt is loosened.
Figure 4:
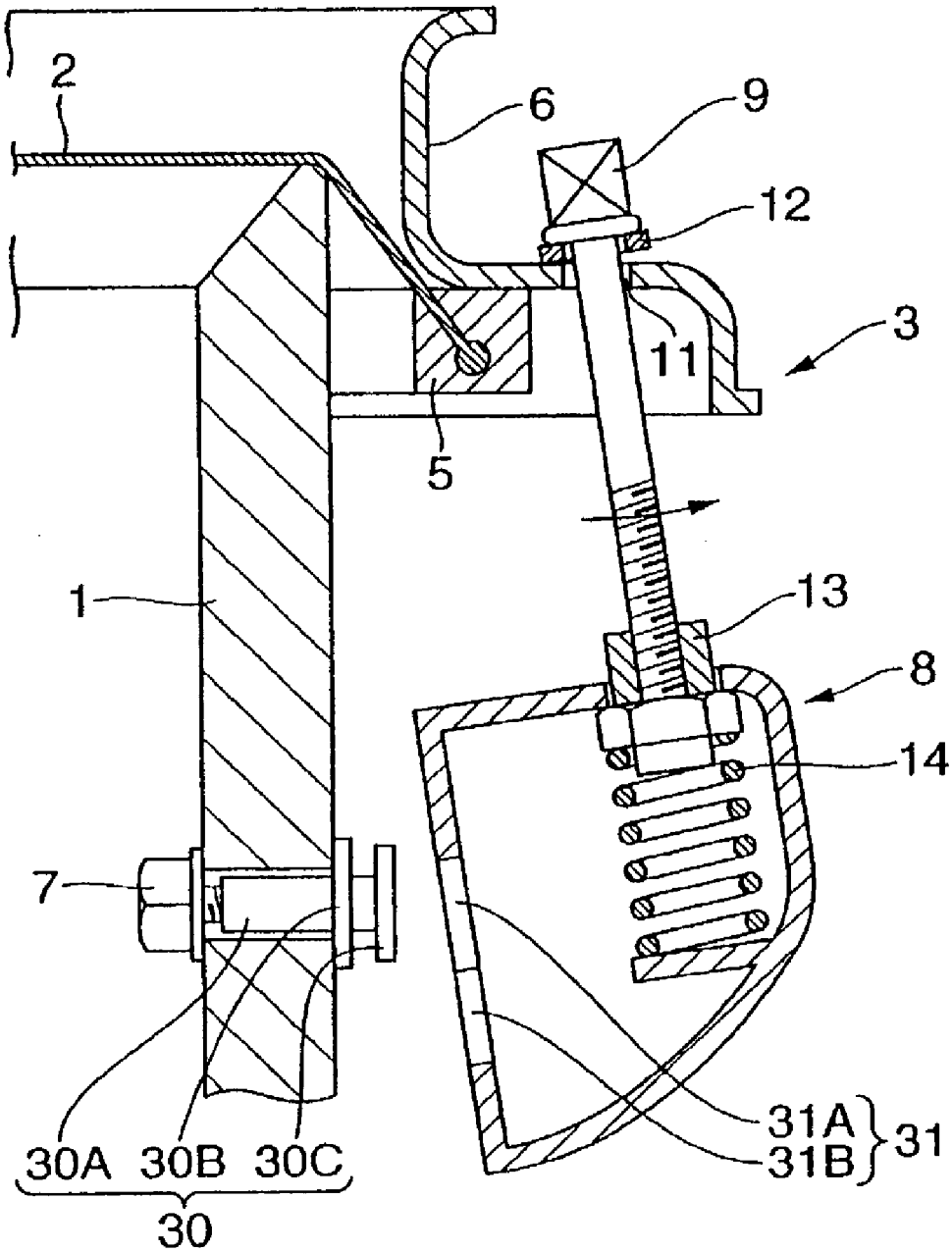
FIG. 4 is a cross sectional view of the lug fixing structure in which a lug is taken off from the outer circumference of a hollow cylinder.
Figure 5:
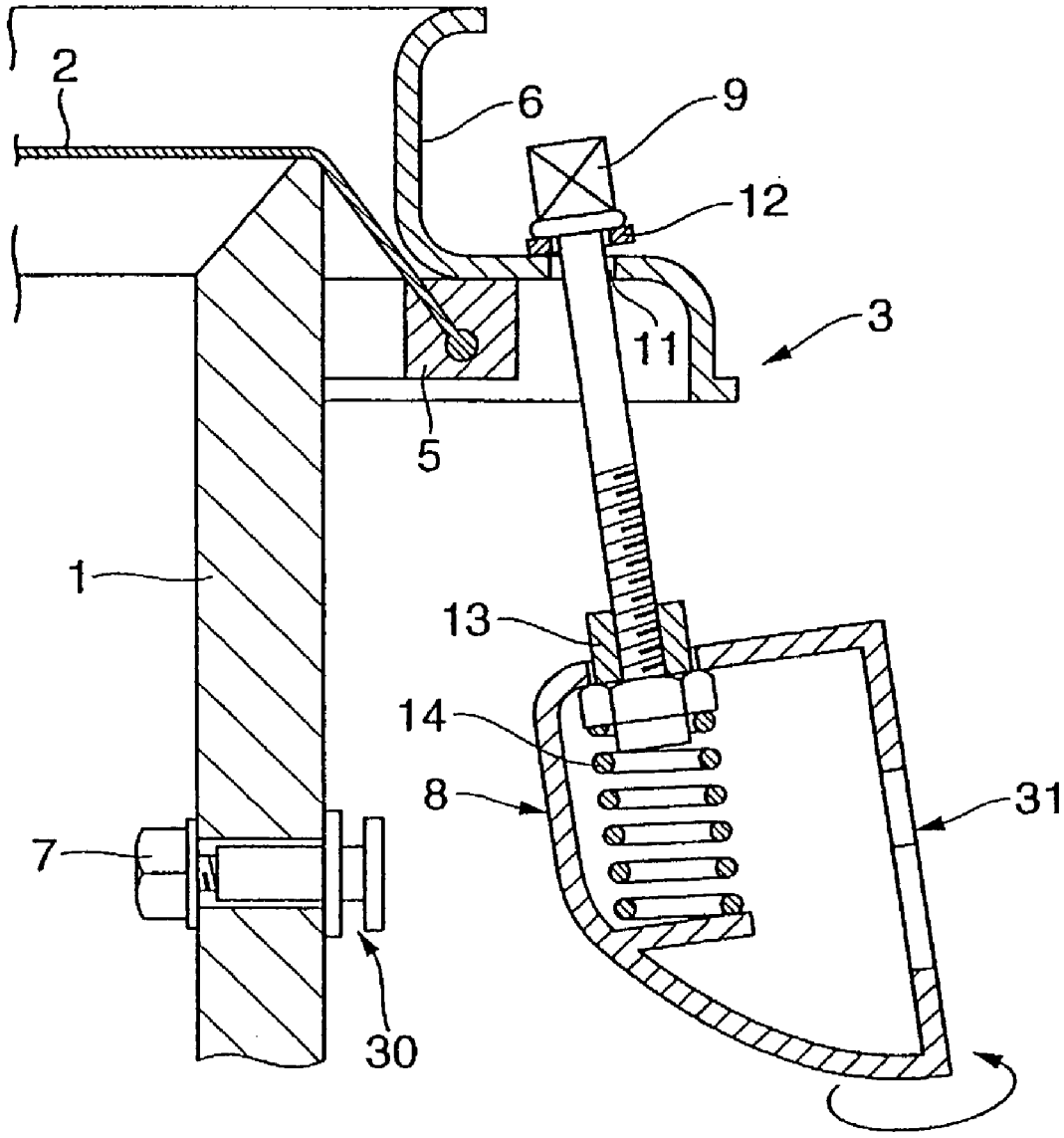
FIG. 5 is a cross sectional view showing the lug fixing structure in which a lug is turned over.
Figure 9:
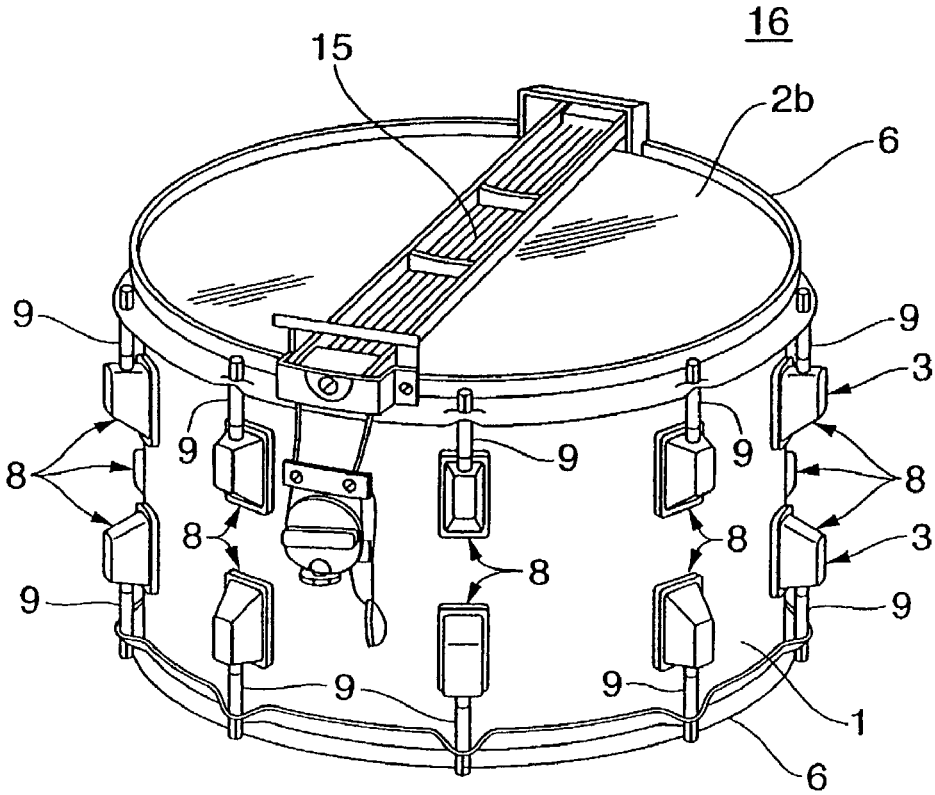
FIG. 9 is a perspective view showing the exterior appearance of a conventional snare drum vertically reversed upside down.
Figure 10:
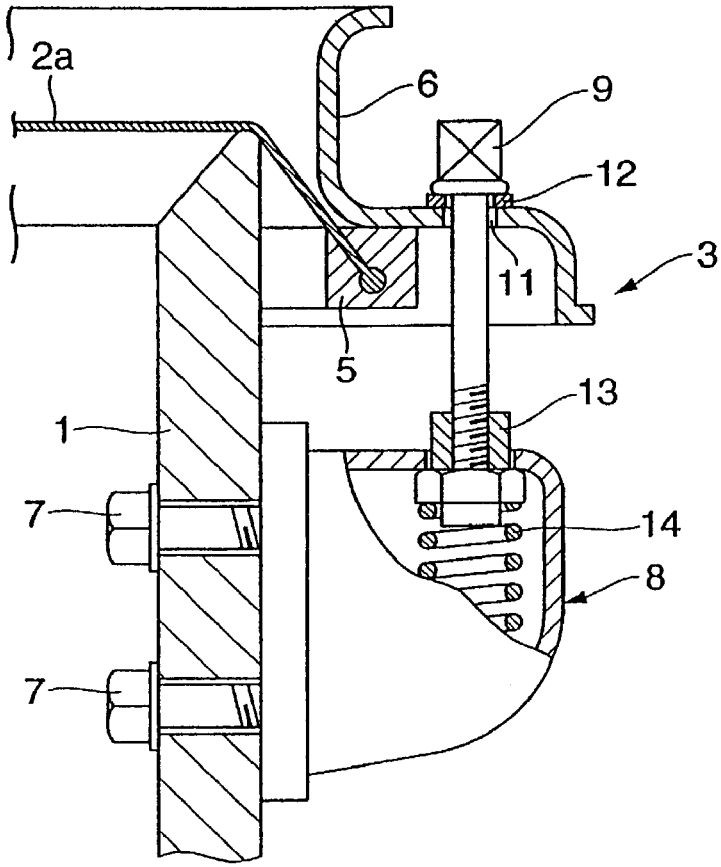
FIG. 10 is a cross sectional view showing a lug fixing structure adapted to the snare drum of FIG. 9.

FIG. 1 is a cross sectional view showing a lug fixing structure for a drum in accordance with a first embodiment of the invention. FIG. 2 is a perspective view showing essential parts of the lug fixing structure shown in FIG. 1. FIG. 3 is a cross sectional view of the lug fixing structure in which a bolt is loosened; FIG. 4 is a cross sectional view of the lug fixing structure in which a lug is taken off from a hollow cylinder; and FIG. 5 is a cross sectional view of the lug fixing structure in which a lug is turned over. In FIGS. 1 to 5, parts identical to those shown in FIGS. 9 and 10 are designated by the same reference numerals; hence, the description thereof will be omitted as necessary.

The lug fixing structure of the first embodiment is designed to detachably attach a lug 8 onto the outer circumference of a hollow cylinder 1 upon an engagement of a lug fixing member 30, which projects from the exterior surface of the outer circumference of the hollow cylinder 1, and an engagement hole 31 formed in the lug 8.

As shown in FIG. 2, the lug fixing member 30 is constituted by a main portion 30A that is formed like a pin having a circular cross section, and a pair of joints 30B and 30C that are integrally connected with the main portion 30A, arranged in parallel with a prescribed distance therebetween, and project from the exterior surface of the tip end portion of the main portion 30A. In addition, a tapped hole (or an internal thread hole) 32 is formed in the base portion of the main portion 30A of the lug fixing member 30. The joints 30B and 30C are arranged to regulate movement of the lug 8 in a horizontal direction, wherein the distance therebetween is slightly greater than the thickness of a rear board 8D of the lug 8. The joint 30B, which is brought into contact with the exterior surface of the hollow cylinder 1, is slightly greater than the other joint 30C, which is arranged at the tip end of the lug fixing member 30, in diameter, so that it functions as a spacer for spacing the lug 8 off from the exterior surface of the hollow cylinder 1. The joint 30C functions as an anti-extraction member for preventing the lug fixing member 30 from being unexpectedly extracted from the engagement hole 31 of the lug 8.

The lug fixing member 30 is fixed to the outer circumference of the hollow cylinder 1 in such a way that it is inserted into a fixing hole 33, which is formed at a prescribed position to penetrate through the circumferential wall of the hollow cylinder 1, from the outside of the hollow cylinder 1, wherein the joint (or spacer) 30B is brought into tight contact with the exterior surface of the hollow cylinder 1, and then, a bolt 7 is screwed into the tapped hole 32 from the inside of the hollow cylinder 1.

The lug 8 is formed as a hollow body, which is constituted by an upper board 8A, a slanted (or curved) bottom board 8B, and a front-side board 8C having a semi-cylindrical shape (or a U-shape) in plan view, as well as the rear board 8D. The lug 8 has a lug nut 13 to be engaged with a bolt 9, and a compression coil spring 14 for upwardly pressing the lug nut 13 therein. Herein, the lug nut 13 is held at a prescribed position of the upper board 8A and is stopped in rotation, wherein the tip end portion thereof projects externally above an opening of a nut hole 34 formed on the upper board 8A of the lug 8. The rear board 8D is inwardly curved like a circular arc having a prescribed curvature roughly equal to that of the exterior circumferential surface of the hollow cylinder 1, wherein the aforementioned engagement hole 31 is formed in a center area of the rear board 8D. Incidentally, the upper board 8A, bottom board 8B, and front-side board 8C are integrally formed together as a single body having an opening, to which the rear board 8D joins by welding and the like.

The engagement hole 31 is formed in a keyhole shape, which is constituted by a large-diameter hole portion 31A and an elongated hole portion 31B, the upper end of which communicates with the lower end of the large-diameter hole portion 31A. In order to allow insertion of the joint 30C formed at the tip end of the lug fixing member 30, the diameter of the large-diameter hole portion 31A is slightly greater than the diameter of the joint 30C but is slightly less than the diameter of the joint 30B, which is spaced apart from the joint 30C along the main portion 30A of the lug fixing member 30. The width of the elongated hole portion 31B is smaller than the diameter of the large-diameter hole portion 31A but is slightly greater than the diameter of the main portion 30A of the lug fixing member 30, wherein it is elongated downwardly from the large-diameter hole portion 31A.

In the above, the lug 8 is fixed to the hollow cylinder 1 in such a way that the joint 30C of the lug fixing member 30 is inserted into the large-diameter hole portion 31A, and then, the lug fixing member 30 is moved downwardly, so that an intermediate portion 30*a* of the main portion 30A between the joints 30B and 30C is engaged with the elongated hole portion 31B of the engagement hole 31 of the lug 8. In addition, both the head frame 5 and the clamp frame 6 are attached to circumferential ends of an opening of the hollow cylinder 1. Furthermore, the bolt 9 is inserted into the bolt fixing hole 11 of the clamp frame 6 via the washer 12, so that the tip end portion thereof is screwed into the lug nut 13. Then, the bolt 9 is tightened using a tuning key (not shown), wherein the clamp frame 6 and the lug 8 move to mutually approach each other, so that the clamp frame 6 clamps the head frame 5 to increase tension of the drumhead 2. At this time, the lug 8 is moved upwardly so that an end wall of the elongated hole 31B of the engagement hole 31 is brought into contact with the intermediate portion 30*a* of the main portion 30A of the lug fixing member 30 under pressure. Thus, it is possible to firmly fix the drumhead 2 and the lug 8 onto the hollow cylinder 1. Under the condition where the lug 8 is fixed to the hollow cylinder 1, the rear board 8D of the lug 8 is arranged in proximity to the exterior circumferential surface of the hollow cylinder 1 by intervention of the spacer 30B, so that it would not be brought into direct contact with the exterior circumferential surface of the hollow cylinder 1.

When the drumhead 2 is replaced with a new one, the bolt 9 is loosened using a tuning key which is not to be completely taken off from lug nut 13, so that, as shown in FIG. 3, the lug 8 and the lug nut 13 are both moved downwards along the bolt 9, wherein the joints 30B and 30C of the lug fixing member 30 substantially match the large-diameter hole portion 31A in horizontal position. The bolt 9 is further rotated so that the lug 8 will depart from the exterior circumferential surface of the hollow cylinder 1 as shown in FIG. 4; then, the lug fixing member 30 is pulled out from the engagement hole 31 of the lug 8. Thereafter, the lug 8 is rotated by 180° so that it is turned over as shown in FIG. 5. The reason why the lug 8 is turned over is to prevent the joints 30B and 30C of the lug fixing member 30 from re-entering into the large-diameter hole portion 31A of the engagement hole 31 of the lug 8 even when the bolt 9 is rotated backwards and is restored to an initial position thereof.

In the aforementioned lug fixing structure in which the lug 8 is detachably attached to the hollow cylinder 1 upon an engagement between the lug fixing member 30 and the engagement hole 31 of the lug 8, the bolt 9 is rotated with a certain value to be loosened so that the joints 30B and 30C of the lug fixing member 30 substantially match the large-diameter hole portion 31A of the engagement hole 31 in horizontal position, and then the lug 8 is rotatably moved to depart from the exterior circumferential surface of the hollow cylinder 1, thus releasing the engagement between the lug fixing member 30 and the engagement hole 31 of the lug 8. This eliminates the necessity of completely removing the bolt 9 from the lug nut 13 in replacement of the drumhead 2; therefore, a human operator (e.g., a player or a user) can replace the drumhead 2 with ease.

Figure 11:
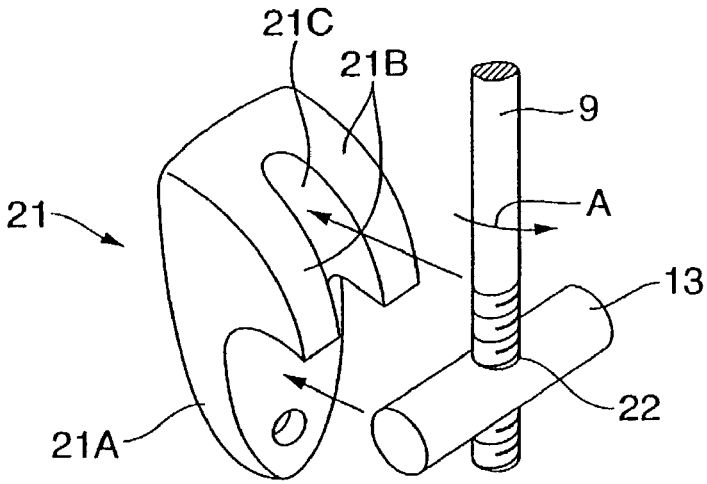
FIG. 11 is a perspective view showing a lug nut fixing structure that can be adapted to the snare drum of FIG. 9.
Figure 12A:
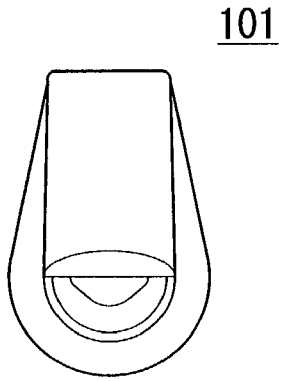
FIG. 12A shows a front side of a lug adapted to the lug fixing structure of this invention.
Figure 12B:
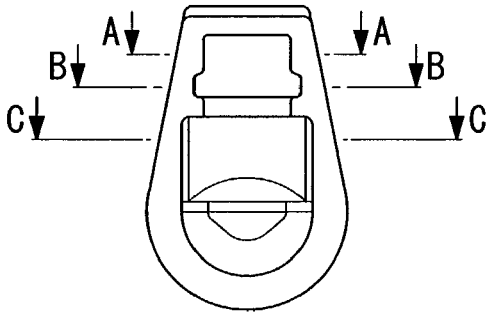
FIG. 12B shows a rear side of the lug shown in FIG. 12A.
Figure 12C:
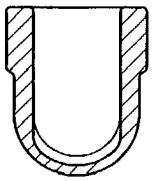
FIG. 12C is a cross sectional view taken along line A—A in FIG. 12B.
Figure 12D:
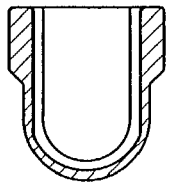
FIG. 12D is a cross sectional view taken along line B—B in FIG. 12B.
Figure 12E:
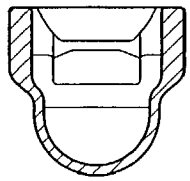
FIG. 12E is a cross sectional view taken along line C—C in FIG. 12B.

In addition, the lug fixing member 8 is formed like a pin, the size of which is sufficiently smaller than the size of the lug 8. Furthermore, the spacer 30B of the lug fixing member 30 is intervened between the rear board 8D of the lug 8 and the exterior circumferential surface of the hollow cylinder 1, so that the lug 8 would not be brought into direct contact with the exterior circumferential surface of the hollow cylinder 1. Therefore, compared with the foregoing lug nut fixing structure shown in FIGS. 9 to 11, it is possible not to prevent the hollow cylinder 1 from vibrating during playing of a drum, so that a tone volume can be increased.

Figure 6:
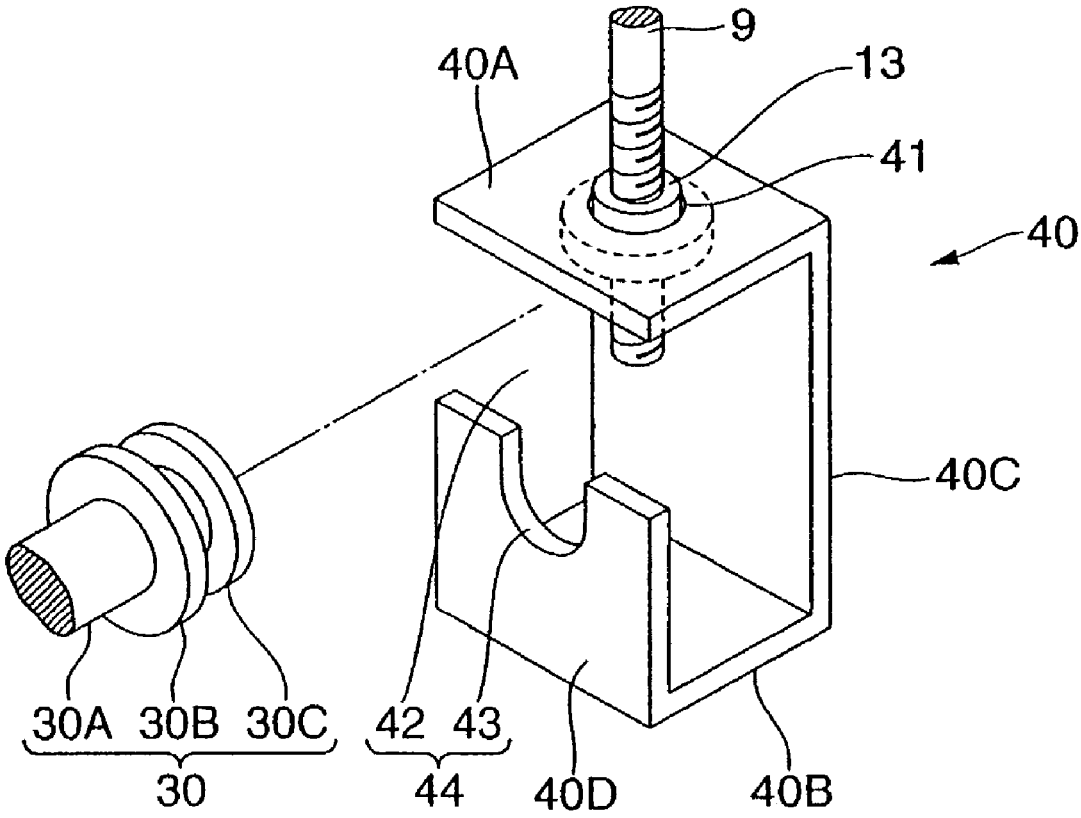
FIG. 6 is a perspective view showing a lug fixing structure in accordance with a second embodiment of the invention.

FIG. 6 is a perspective view showing a lug fixing structure in accordance with a second embodiment of the invention, wherein parts identical to those shown in FIG. 2 are designated by the same reference numerals.

In FIG. 6, a lug 40 is formed by bending and processing a metal plate, wherein it is formed like a rectangular box in side view, which is constituted by an upper board 40A, a bottom board 40B, a front board 40C, and a rear board 40D. Herein, the lug 40 having a rectangular box shape has rectangular openings at both sides thereof and another opening formed above the rear board 40D. Specifically, a nut hole 41 is formed at a prescribed position of the upper board 40A to allow the upper end portion of the lug nut 13 to penetrate therethrough, and an opening space 42 is formed between the upper board 40A and the rear board 40D, whose upper end portion is partially cut in a U-shape to form a slot 43. The lug nut 13 is fixed to the lower surface of the upper board 40A by welding and the like; therefore, the lug fixing structure of FIG. 6 does not require the aforementioned compression coil spring 14. The opening space 42 and the U-shape slot 43 correspond to the aforementioned large-diameter hole portion 31A and the elongated hole portion 31B shown in FIG. 2, so that they are combined together to form an engagement hole 44 that can engage with the lug fixing member 30, the configuration of which is identical to that shown in FIG. 2.

In the lug fixing structure shown in FIG. 6, the lug 40 is formed by bending and processing a metal plate; therefore, it is possible to produce the lug 40 with ease, and it is possible to reduce the cost for manufacturing it.

The lugs 8 and lug nuts 13 can be modified in a variety of ways, wherein examples will be described below.

Figure 13A:
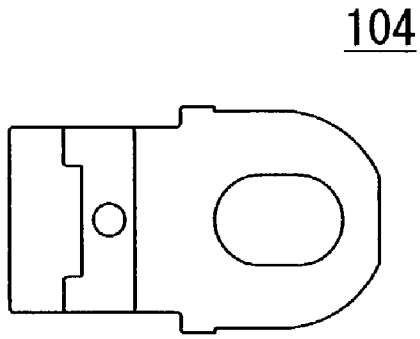
FIG. 13A is an upper view showing a lug nut support that is equipped with the lug shown in FIGS. 12A to 12E.
Figure 13B:
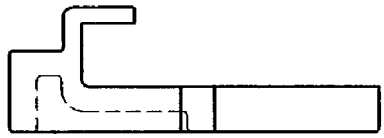
FIG. 13B is a side view of the lug nut support.
Figure 13C:
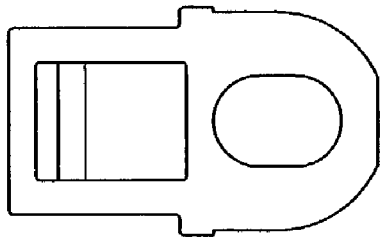
FIG. 13C is a lower view of the lug nut support.
Figure 14:
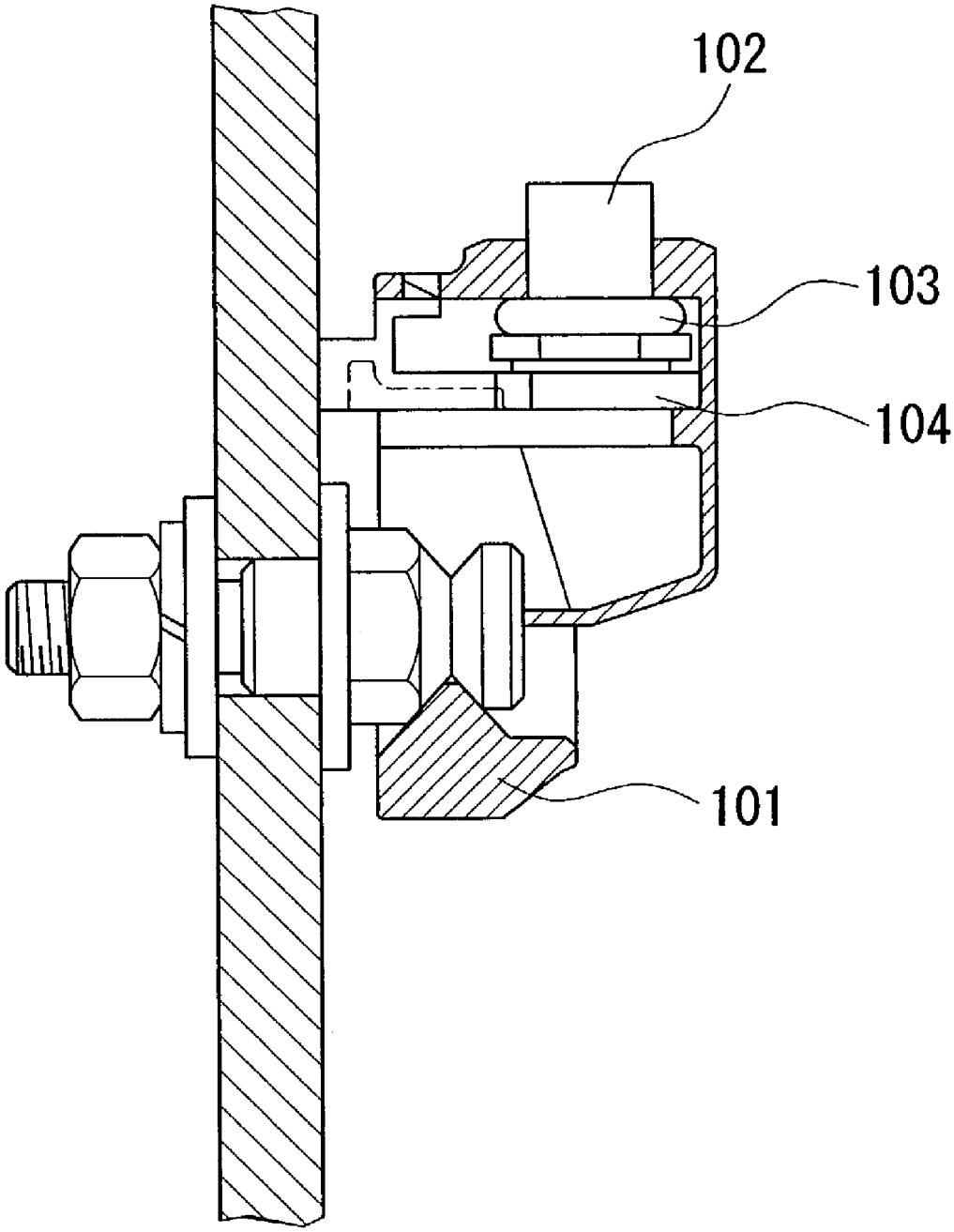
FIG. 14 shows an arrangement of the lug and lug nut support, which are assembled together.

FIGS. 12A to 12E show an example of a lug 101 adapted to the lug fixing structure of this invention, wherein the lug 101 is made of a metal material or a plastic material, for example, and it does not have a rear board so that the internal hollow thereof can be visually observed from the rear side thereof. The tip end portion of a lug fixing member (or a bolt on shell) is hooked on an hooked portion (i.e., a hole) that is formed in the lower portion of the lug 101. Due to the formation of a hole, a human operator can easily attach the lug fixing member onto the lug while visually confirming an engaged state therebetween. Of course, the hooked portion is not necessarily limited to the hole and can be designed in different manners having an ability of securing engagement therebetween. A small projection is formed inside of the lug 101 to engage a lug nut support 104, details of which are shown in FIGS. 13A to 13C. The lug nut support 104 is made of an elastic material having a deforming ability such as a plastic material, wherein it is formed like a small board having a hole allowing a bolt to be inserted at the center thereof. In order to secure attachment of the lug nut support 104 onto the lug 101, it is possible to arrange an engagement member (e.g., a hook) as shown in FIG. 13B. After insertion of a lug nut 102 having a O-ring 103 into the lug 101, the lug nut support 104 is engaged with a prescribed engagement portion of the lug 101 (see FIG. 12B); then, a bolt is inserted into the lug 101, so that the aforementioned members are vertically arranged as shown in FIG. 14. Due to the arrangement of the lug nut support 104, it is possible to reliably prevent the lug nut 102 from falling off inside of the lug 101 during insertion of the bolt.

Figure 7A:
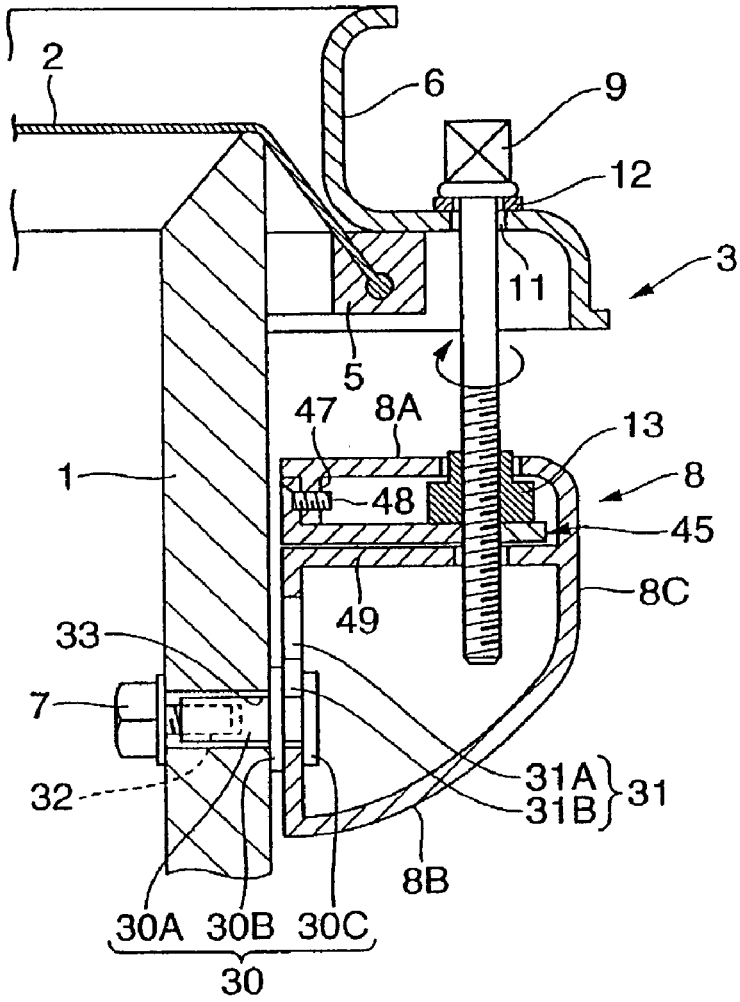
FIG. 7A is a cross sectional view showing a lug fixing structure in accordance with a third embodiment of the invention.
Figure 7B:
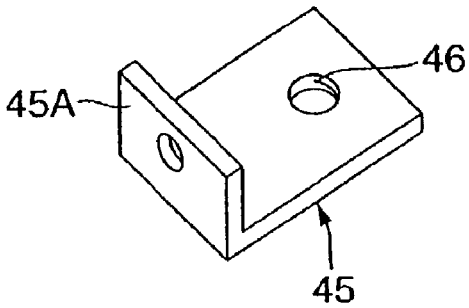
FIG. 7B is a perspective view showing a rotation stop board that is adapted to a lug shown in FIG. 7A.

Next, a lug fixing structure of a third embodiment of the invention will be described with reference to FIGS. 7A and 7B, wherein FIG. 7A is a cross sectional view showing the lug fixing structure of the third embodiment, and FIG. 7B is a perspective view showing a rotation stop board that is adapted to a lug, wherein parts identical to those shown in FIG. 1 will be designated by the same reference numerals; hence, the description thereof will be omitted as necessary.

The lug fixing structure of the third embodiment is characterized by substituting a lug nut support 45 shown in FIG. 7B for the aforementioned compression coil spring 14, whereby the bolt 9 is prevented from being unexpectedly loosened. That is, the lug nut support 45 is made of a plastic and the like, wherein a tapped hole 46 to be engaged with the bolt 9 is formed at approximately the center of the tip end portion of the lug nut support 45; and the base portion of the lug nut support 45 is bent perpendicularly to form a bent portion 45A, which is fixed to a fixing portion 47 arranged at a prescribed position of the rear board of the lug 8 by a vis (or a small screw) 48. Herein, the lug nut support 45 is mounted on a partition board 49 that partitions the inside space of the lug 8 and is formed integrally with the lug 8. Other parts of the third embodiment are substantially similar to those of the first embodiment. Compared with the first embodiment, the third embodiment is characterized by not requiring the compression coil spring 14.

Incidentally, the third embodiment does not necessarily provide the partition board 49, which can be replaced with an engagement structure, such as the aforementioned projection formed inside of the lug (see FIG. 12B), which guarantees engagement with the lug nut support 45 inside of the lug 8.

Figure 8A:
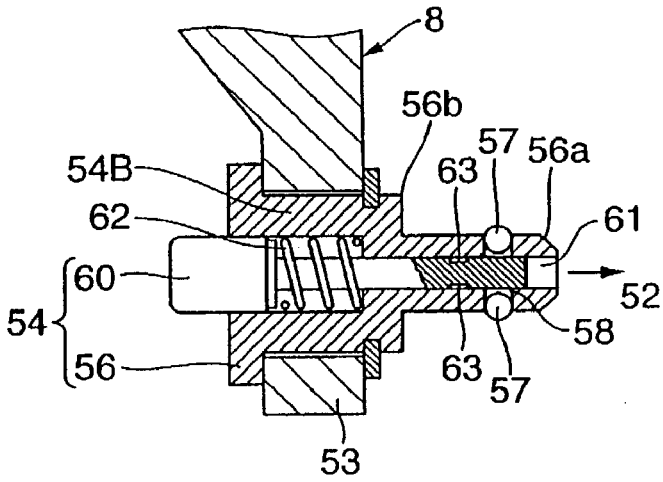
FIG. 8A is a cross sectional view showing an engagement member for use in a lug fixing structure in accordance with a fourth embodiment of the invention.
Figure 8B:
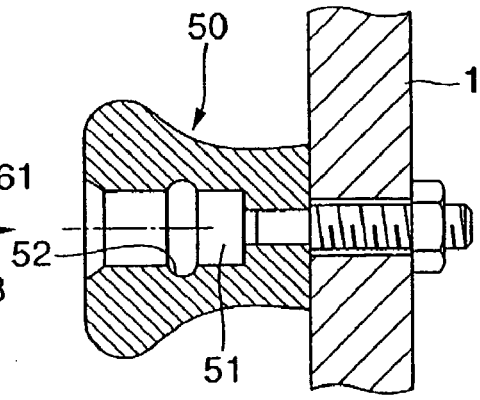
FIG. 8B is a cross sectional view showing a lug fixing member that is engaged with the engagement member shown in FIG. 8A.

Next, a lug fixing structure of a fourth embodiment of the invention will be described with reference to FIGS. 8A and 8B, wherein FIG. 8A is a cross sectional view showing an engagement member, and FIG. 8B is a cross sectional view showing a lug fixing member to be engaged with the engagement member shown in FIG. 8A.

In the lug fixing structure of the fourth embodiment, an insertion hole 51 is formed to penetrate through a tip end portion of a lug fixing member 50 that projects externally from the exterior circumferential surface of the hollow cylinder 1, and a ring channel 52 is formed inside of the insertion hole 51. In addition, an engagement member 54 is arranged on a terminal portion 53 of the lug 8 opposite to a bolt (not shown) in order to engage with the lug fixing member 50.

The engagement member 54 has a main portion 56 having a pin shape, which is to be inserted into the insertion hole 51 of the lug fixing member 50, wherein the base end of the main portion 56 forms a fixing portion 56*b* fixed to the terminal portion 53 of the lug 8. A tip end portion 56*a* of the main portion 56 has a diameter that is slightly smaller than the diameter of the insertion hole 51, and two balls 57 are built in circumferential walls of the tip end portion 56*a* of the main portion 56 in such a way that when the tip end portion 56*a* is inserted into the insertion hole 51 of the lug fixing member 50, the balls 57 can be freely retracted into circumferential walls of the tip end portion 56*a* and then moved outwardly to match the engagement channel 52 inside of the insertion hole 51. That is, the balls 57 are arranged on both ends of a through hole 58 that is formed to penetrate through the tip end portion 56*a* in a direction perpendicular to an axial line of the main portion 56. Herein, each of openings of both ends of the through hole 58 has a diameter that is slightly smaller than the diameter of each of the balls 57 in order to prevent balls 57 from falling off from the through hole 58.

An engagement releasing pin 60 is built in the main portion 56 of the engagement member 54 in order to release the balls 57 engaging with the engagement channel 52 inside of the insertion hole 51 of the lug fixing member 50. Herein, the engagement releasing pin 60 is inserted into a through hole 60, which is formed to penetrate through the main portion 56 of the engagement member 54, so that it can be freely moved along the through hole 60 but is reliably prevented from being extracted from the fixing portion 56*b*. In addition, the engagement releasing pin 60 is normally pressed towards the fixing portion 56*b* by a compression coil spring 62. A small hemispherical hollow 63 is formed on the exterior circumferential surface of the tip end portion of the engagement releasing pin 60 in conformity with the balls 57.

When the engagement member 54 is interconnected with the lug fixing member 50, the engagement releasing pin 60 is pressed into the through hole 61 against retracting force of the compression coil spring 62 so as to match the hollow 63 thereof with the balls 57. In this state, the tip end portion 56*a* of the main portion 56 of the engagement member 54 is inserted into the insertion hole 51 of the lug fixing member 50 so that the balls 57 match the engagement channel 52. Then, the engagement releasing pin 60 pressed into the through hole 61 is released in pressure, so that the engagement releasing pin 60 automatically moves backwards due to retracting force of the compression coil spring 62, whereby the balls 57 escape from the hollow 63 of the engagement releasing pin 60. Thus, it is possible to securely engage the engagement member 54 with the lug fixing member 50.

In order to extract the engagement member 54 from the lug fixing member 50, the engagement releasing pin 60 is pressed into the through hole 61 against retracting force of the compression coil spring 62 so that the balls 57 match the hollow 63 thereof. In this state, it is possible to extract the engagement member 54 from the lug fixing member 50 with ease.

Of course, this invention is not necessarily limited to the aforementioned embodiments; hence, it is possible to partially change or modify them within the scope of the invention. For example, the aforementioned engagement hole 31 of the lug 8 shown in FIG. 2 is not necessarily limited to a keyhole shape; therefore, it can be changed to a circular shape or the like.

This invention has a variety of effects and technical features, which will be described below.

(1) A lug fixing structure of this invention is designed to eliminate a necessity of taking off a bolt from a lug nut when replacing a drumhead with a new one. Therefore, it is possible to rapidly replace the drumhead with a new one with ease.

(2) In the above, the lug is turned over after being taken off from a hollow cylinder of a drum by releasing an engagement between a lug fixing member and an engagement hole (or an engagement member). Therefore, even when the bolt is rotated and is restored to an initial position thereof so that the lug unexpectedly comes in contact with the lug fixing member, it is possible to reliably prevent the lug fixing member from engaging with the engagement hole (or engagement member) again. That is, a human operator does not necessarily temporarily hold the bolt by a hand not to be restored to an initial position. This provides a further improvement in replacing a drumhead with a new one.

(3) Furthermore, the lug fixing member has a spacer by which the lug would not be brought into direct contact with the exterior circumferential surface of the hollow cylinder. Thus, it is possible to increase a tone volume of the drum when played because the lug is spaced apart from the exterior circumferential surface of the hollow cylinder and does not prevent the hollow cylinder from vibrating during playing of the drum.

As this invention may be embodied in several forms without departing from the spirit or essential characteristics thereof, the present embodiments are therefore illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A lug fixing structure for a drum, comprising:

a plurality of lugs each equipped with a lug nut and an engagement portion, the lugs being arranged with prescribed distances therebetween along an exterior circumferential surface of a hollow cylinder;

a plurality of bolts respectively engaged with the plurality of lug nuts;

a lug nut support provided inside of each lug and under the lug nut for supporting the lug nut so as to be held in the lug;

a clamp frame for clamping a head frame holding circumferential ends of a drumhead stretched at ends of an opening of the hollow cylinder, wherein the clamp frame is interconnected with the hollow cylinder by the plurality of bolts; and a plurality of lug fixing members fixed on the hollow cylinder so as to be arranged in conformity with the plurality of lugs respectively, each of the plurality of the lug fixing members having a projecting portion that projects from an exterior circumferential surface of the hollow cylinder, wherein each projecting portion is removeably engaged and detachable from the engagement portion of a respective lug.

2. The lug fixing structure for a drum according to claim 1, wherein each of the lugs has an engagement hole having a keyhole shape that engages with each of the lug fixing members.

3. The lug fixing structure for a drum according to claim 1, wherein each of the lug fixing members has a spacer by which each of the lugs is spaced apart from the exterior circumferential surface of the hollow cylinder.

4. The lug fixing structure for a drum according to claim 1 or 3, wherein each of the lugs has an engagement hole having a keyhole shape that engages with each of the lug fixing members, and wherein each of the lug fixing members has an anti-extraction portion at a tip end thereof to avoid extraction thereof from the engagement hole of the lug.

5. The lug fixing structure for a drum according to any one of claims 1 to 3, wherein each of the lugs has a prescribed shape whose rear portion allows engagement with each of the lug fixing members and which allows turnover after releasing engagement with the lug fixing member.

6. The lug fixing structure for a drum according to claim 1, wherein the lug fixing member interconnected with the hollow cylinder has an insertion hole, into which a tip end portion of an engagement member interconnected with the lug is inserted, and wherein a plurality of retractable balls are arranged in the tip end portion of the engagement member, so that when inserted into the insertion hole of the lug fixing member, the balls are engaged with an engagement channel formed inside of the insertion hole by being partially projected upon manipulation of a pin.

7. The lug fixing structure for a drum according to claim 1, wherein said lug nut support is engaged on the inside of the lug, which supports the lug nut and which has a through hole into which the bolt is inserted.

8. The lug fixing structure for a drum according to claim 1, wherein said lug nut support is a compression coil spring for upwardly pressing said lug nut.

* * * * *